US007927259B1

(12) United States Patent
Rix

(10) Patent No.: US 7,927,259 B1
(45) Date of Patent: Apr. 19, 2011

(54) BODY IMPACT TRAINER SYSTEM

(76) Inventor: Paul B. Rix, Holiday, FL (US)

( * ) Notice: Subject to any disclaimer, the term of this patent is extended or adjusted under 35 U.S.C. 154(b) by 0 days.

(21) Appl. No.: 12/583,733

(22) Filed: Aug. 25, 2009

Related U.S. Application Data

(60) Provisional application No. 61/190,087, filed on Aug. 26, 2008.

(51) Int. Cl.
*A63B 21/00* (2006.01)

(52) U.S. Cl. ..... 482/83; 601/107; 601/41

(58) Field of Classification Search ..... 601/107, 601/41, 239; 606/239; 482/83
See application file for complete search history.

(56) References Cited

U.S. PATENT DOCUMENTS

| | | | | |
|---|---|---|---|---|
| 5,399,148 | A * | 3/1995 | Waide et al. | 601/41 |
| 6,228,042 | B1 * | 5/2001 | Dungan | 601/107 |
| 6,805,700 | B2 * | 10/2004 | Miller | 606/239 |
| 2005/0090863 | A1 * | 4/2005 | Miller | 606/239 |

* cited by examiner

*Primary Examiner* — Jerome W Donnelly

(57) ABSTRACT

A punch pad assembly is provided. A plurality of support plates are coupled with respect to the punch pad assembly. A motor is provided. The motor operatively couples the support plates with respect to a trigger. In this manner the punch pad assembly may be reciprocated at a rate of between 300 and 700 strokes per minute with a stroke length of between 0.875 and 1.000 inches.

4 Claims, 3 Drawing Sheets

FIG 1
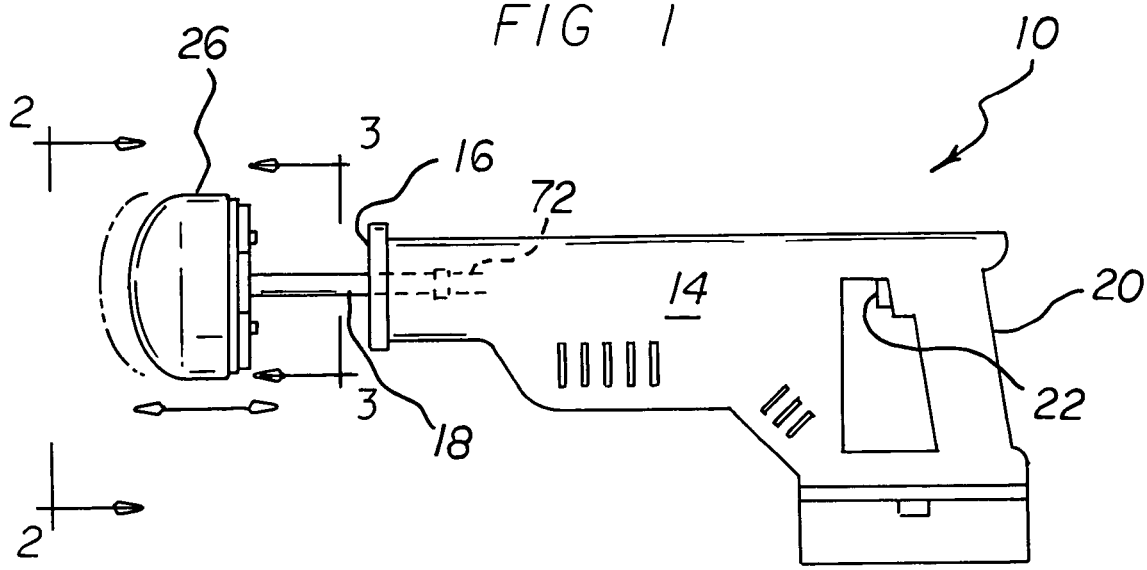
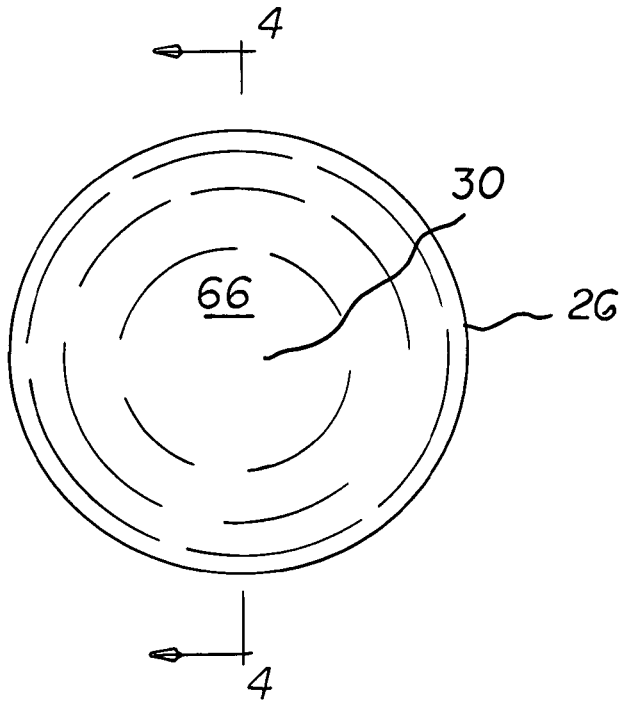
FIG 2

FIG 3
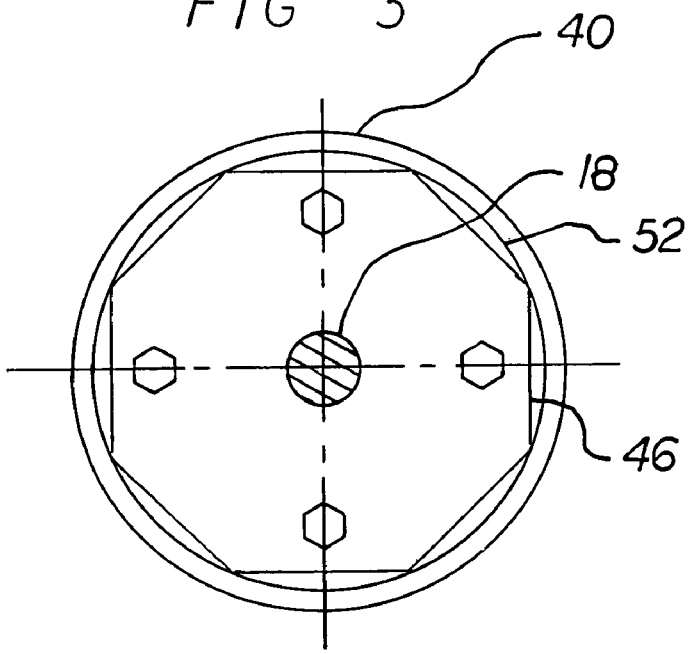
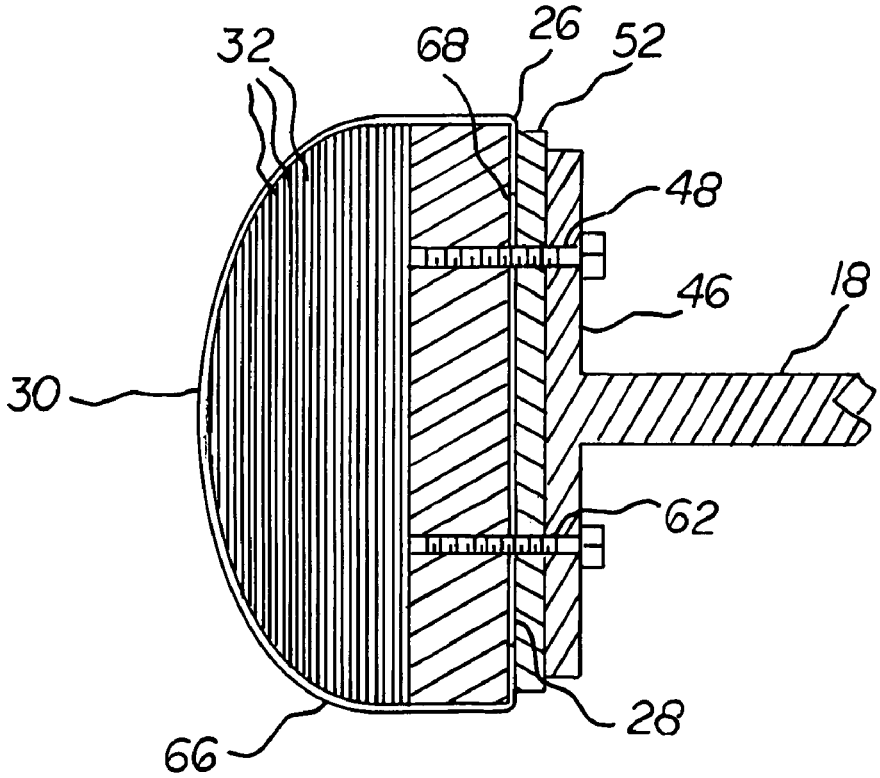
FIG 4

BODY IMPACT TRAINER SYSTEM

RELATED APPLICATION

This application is based upon Provisional Application Ser. No. 61/190,087 filed Aug. 26, 2008, the subject matter of which is incorporated herein by reference.

BACKGROUND OF THE INVENTION

Field of the Invention

The present invention relates to a body impact trainer system and more particularly pertains to conditioning an athlete's body to impact thereby reducing the risk of injury and enhancing athletic performance, the conditioning being done in a safe, convenient and economical manner.

SUMMARY OF THE INVENTION

In view of the foregoing disadvantages inherent in the known types of training systems of known designs and configurations now present in the prior art, the present invention provides an improved body impact trainer system. As such, the general purpose of the present invention, which will be described subsequently in greater detail, is to provide a new and improved body impact trainer system and method which has all the advantages of the prior art and none of the disadvantages.

To attain this, the present invention essentially comprises a body impact trainer system. First provided is a reciprocating electrical saw. The saw has an operational end. The operational end has a reciprocable rod. The saw has a handle end. The handle end has a trigger. In this manner the rod may be reciprocated at a rate proportionate to a user's force applied to the trigger.

A punch pad assembly is provided. The punch pad assembly is in a generally semi-spherical configuration. The punch pad assembly has a planar interior end. The interior end faces the saw. The punch pad assembly has a curved exterior end. The exterior end faces away from the saw. The punch pad assembly has a plurality of circular pieces. The circular pieces are of soft terry-cloth. The circular pieces have a continuously decreasing diameter. The circular pieces constitute an inner filling. The circular pieces include a circular piece closest to the interior end. The circular piece closest to the interior end has the largest diameter. The circular pieces include a circular piece farthest from the interior end. The circular piece farthest from the interior end has the smallest diameter.

The punch pad assembly has an outer support plate. The outer support place is in a circular configuration. The outer support plate is fabricated of oak plywood. The plywood has a thickness of about 0.75 inches. The plywood has a diameter of about 4.5 inches. The outer support plate has a periphery. The periphery of the outer support plate has four equally spaced threaded outer apertures. The outer support plate has metal threaded inserts. The inserts are provided adjacent to the periphery.

The punch pad assembly has an inner support plate. The inner support plate is in a 3.5 inch square configuration. The inner support plate has truncated corners. The inner support plate is fabricated of aluminum. The aluminum has a thickness of about 0.125 inches. The inner support plate has four equally spaced unthreaded inner apertures.

The punch pad assembly has an intermediate support plate. The intermediate support plate is in a circular configuration. The intermediate support plate is fabricated of aluminum. The aluminum has a thickness of about 0.25 inches. The aluminum has a diameter of about 4.375 inches. The outer support plate has a periphery. The periphery of the outer support plate has eight equally spaced intermediate apertures. The intermediate apertures include four unthreaded intermediate apertures. The unthreaded intermediate apertures are aligned with the threaded outer apertures. The intermediate apertures include four threaded intermediate apertures. The threaded intermediate apertures are aligned with the unthreaded inner apertures.

The punch pad assembly has four primary bolts. The primary bolts extend through the outer and intermediate support plates for coupling purposes. The punch pad assembly has four secondary bolts. The secondary bolts extend through the apertures of the inner and intermediate plates for coupling purposes.

The punch pad assembly has a leather covering. The covering encompasses the circular pieces and the periphery of the exterior support plate. The covering has a periphery. The periphery of the covering is secured between the exterior and intermediate support plates.

Provided last is a motor. The motor operatively couples the trigger and the punch pad assembly. In this manner the punch pad assembly may be reciprocated at a rate of between 300 and 700 strokes per minute with a stroke length of between 0.875 and 1.000 inches.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved body impact trainer system which has all of the advantages of the prior art training systems of known designs and configurations and none of the disadvantages.

It is another object of the present invention to provide a new and improved body impact trainer system which may be easily and efficiently manufactured and marketed.

It is further object of the present invention to provide a new and improved body impact trainer system which is of durable and reliable constructions.

An even further object of the present invention is to provide a new and improved body impact trainer system which is susceptible of a low cost of manufacture with regard to both materials and labor, and which accordingly is then susceptible of low prices of sale to the consuming public, thereby making such body impact trainer system economically available to the buying public.

Even still another object of the present invention is to provide a body impact trainer system for conditioning an athlete's body to impact thereby reducing the risk of injury and enhancing athletic performance, the conditioning being done in a safe, convenient and economical manner.

Lastly, it is an object of the present invention to provide a new and improved body impact trainer system. A punch pad assembly is provided. A plurality of support plates are coupled with respect to the punch pad assembly. A motor is provided. The motor operatively couples the support plates with respect to a trigger. In this manner the punch pad assembly may be reciprocated at a rate of between 300 and 700 strokes per minute with a stroke length of between 0.875 and 1.000 inches.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a body impact trainer system constructed in accordance with the principles of the present invention.

FIG. 2 is front view of the body impact trainer system taken along line 2-2 of FIG. 1.

FIG. 3 is a cross-sectional view taken alone line 3-3 of FIG. 1.

FIG. 4 is a cross-sectional view taken along line 4-4 of FIG. 2.

The same reference numerals refer to the same parts throughout the various Figures.

DESCRIPTION OF THE PREFERRED EMBODIMENT

Figure 5:
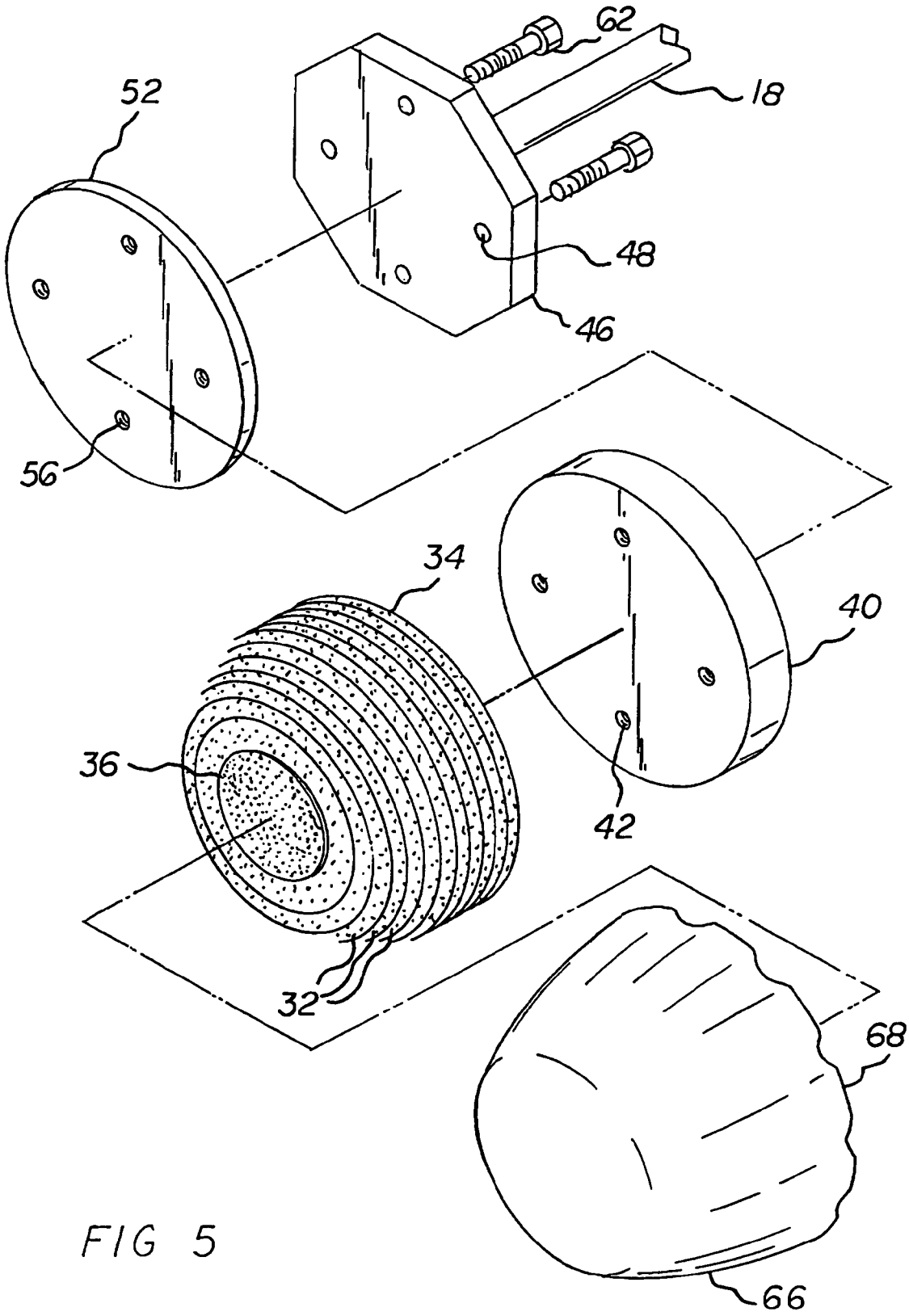
FIG. 5 is an exploded perspective view of the punch pad assembly of the present invention.

With reference now to the drawings, and in particular to FIG. 1 thereof, the preferred embodiment of the new and improved body impact trainer system embodying the principles and concepts of the present invention and generally designated by the reference numeral 10 will be described.

The present invention, the body impact trainer system 10 is comprised of a plurality of components. Such components in their broadest context include a punch pad assembly, a plurality of support plates and a motor. Such components are individually configured and correlated with respect to each other so as to attain the desired objective.

First provided is a reciprocating electrical saw 14. The saw has an operational end 16. The operational end has a reciprocable rod 18. The saw has a handle end 20. The handle end has a trigger 22. In this manner the rod may be reciprocated at a rate proportionate to a user's force applied to the trigger.

A punch pad assembly 26 is provided. The punch pad assembly is in a generally semi-spherical configuration. The punch pad assembly has a planar interior end 28. The interior end faces the saw. The punch pad assembly has a curved exterior end 30. The exterior end faces away from the saw. The punch pad assembly has a plurality of circular pieces 32. The circular pieces are of soft terry-cloth. The circular pieces have a continuously decreasing diameter. The circular pieces constitute an inner filling. The circular pieces include a circular piece closest to the interior end 34. The circular piece closest to the interior end has the largest diameter. The circular pieces include a circular piece farthest from the interior end 36. The circular piece farthest from the interior end has the smallest diameter.

The punch pad assembly has an outer support plate 40. The outer support place is in a circular configuration. The outer support plate is fabricated of oak plywood. The plywood has a thickness of about 0.75 inches. The plywood has a diameter of about 4.5 inches. The outer support plate has a periphery. The periphery of the outer support plate has four equally spaced threaded outer apertures. The outer support plate has metal threaded inserts 42. The inserts are provided adjacent to the periphery.

The punch pad assembly has an inner support plate 46. The inner support plate is in a 3.5 inch square configuration. The inner support plate has truncated corners. The inner support plate is fabricated of aluminum. The aluminum has a thickness of about 0.125 inches. The inner support plate has four equally spaced unthreaded inner apertures 48.

The punch pad assembly has an intermediate support plate 52. The intermediate support plate is in a circular configuration. The intermediate support plate is fabricated of aluminum. The aluminum has a thickness of about 0.25 inches. The aluminum has a diameter of about 4.375 inches. The outer support plate has a periphery. The periphery of the outer support plate has eight equally spaced intermediate apertures. The intermediate apertures include four unthreaded intermediate apertures 54. The unthreaded intermediate apertures are aligned with the threaded outer apertures. The intermediate apertures include four threaded intermediate apertures 56. The threaded intermediate apertures are aligned with the unthreaded inner apertures.

The punch pad assembly has four primary bolts 60. The primary bolts extend through the outer and intermediate support plates for coupling purposes. The punch pad assembly has four secondary bolts 62. The secondary bolts extend through the apertures of the inner and intermediate plates for coupling purposes.

The punch pad assembly has a leather covering 66. The covering encompasses the circular pieces and the periphery of the exterior support plate. The covering has a periphery 68. The periphery of the covering is secured between the exterior and intermediate support plates.

Provided last is a motor 72. The motor operatively couples the trigger and the punch pad assembly. In this manner the punch pad assembly may be reciprocated at a rate of between 300 and 700 strokes per minute with a stroke length of between 0.875 and 1.000 inches.

The body impact trainer system of the present invention was designed for trainers of athletes, especially for full contact sports such a boxing, mixed martial arts, football, soccer, etc. Its purposes include conditioning the body in certain areas for impact thereby reducing the risk of injury and enhancing the athlete's performance. It works excellently for highly developed muscles that need much more impact than any massage machine can provide. This machine will help mixed martial arts and boxing athletes endure a punch to the head with less risk of injury or knockout. Abdominal conditioning is another example. An alternate attachment is provided for bone conditioning such as shin strikes. Trainers all over the world will appreciate the body impact trainer constructed in accordance with the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A body impact trainer system comprising:

a punch pad assembly;

a plurality of support plates coupled with respect to the punch pad assembly, the support plates including;

an outer support plate fabricated of oak plywood with a thickness of about 0.75 inches, the outer support plate having a periphery with equally spaced threaded outer apertures adjacent to the periphery, the outer apertures having metal threaded inserts;

an inner support plate fabricated of aluminum with a thickness of about 0.125 inches, the inner support plate having equally spaced unthreaded inner apertures; and an intermediate support plate fabricated of aluminum with a thickness of about 0.25 inches, the outer support plate having a periphery with equally spaced intermediate apertures including unthreaded intermediate apertures aligned with the threaded outer apertures and threaded intermediate apertures aligned with the unthreaded inner apertures;

primary bolts extending through the outer and intermediate support plates for coupling purposes and secondary bolts extending through the apertures of the inner and intermediate plates for coupling purposes; and a motor for operatively coupling the support plates with respect to a trigger for reciprocating the punch pad assembly at a rate of between 300 and 700 strokes per minute with a stroke length of between 0.875 and 1.000 inches.

2. A body impact trainer system comprising:

a punch pad assembly semi-spherical in configuration with a planar interior end and a curved exterior end, the assembly being formed of a plurality of circular pieces of soft cloth of continuously decreasing diameter constituting an inner filling, the circular piece closest to the interior end having the greatest diameter, the circular piece farthest from the interior end having the smallest diameter;

a plurality of support plates coupled with respect to the punch pad assembly; and a motor for operatively coupling the support plates with respect to a trigger for reciprocating the punch pad assembly at a rate of between 300 and 700 strokes per minute with a stroke length of between 0.875 and 1.000 inches.

3. The system as set forth in claim 2 and further including a leather covering encompassing the circular pieces.

4. A body impact trainer system for conditioning an athlete's body to impact thereby reducing the risk of injury and enhancing athletic performance, the system comprising, in combination:

a reciprocating electrical saw having an operational end with a reciprocable rod, the saw having a handle end with a trigger to reciprocate the rod at a rate proportionate to a user's force applied to the trigger;

a punch pad assembly in a generally semi-spherical configuration, the punch pad assembly having a planar interior end facing the saw and a curved exterior end facing away from the saw, the punch pad assembly being formed of a plurality of circular pieces of soft terry-cloth with continuously decreasing diameter and constituting an inner filling, the circular piece closest to the interior end having the largest diameter, the circular piece farthest from the interior end having the smallest diameter;

the punch pad assembly having an inner support plate in a circular configuration fabricated of oak plywood with a thickness of about 0.75 inches and a diameter of about 4.5 inches, the inner support plate having a periphery with four equally spaced unthreaded inner apertures with metal threaded inserts adjacent to the periphery;

the punch pad assembly having an outer support plate in a 3.5 inch square configuration with truncated corners, the outer support plate being fabricated of aluminum with a thickness of about 0.125 inches, the outer support plate having four equally spaced unthreaded outer apertures;

the punch pad assembly having an intermediate support plate in a circular configuration fabricated of aluminum with a thickness of about 0.25 inches and a diameter of about 4.375 inches, the outer support plate having a periphery with four equally spaced unthreaded intermediate apertures aligned with the inner apertures and with the outer apertures;

the punch pad assembly having four primary bolts extending through the outer and intermediate and inner support plates for coupling purposes;

the punch pad assembly having a leather covering encompassing the circular pieces and the periphery of the inner support plate, the covering having a periphery secured between the inner and intermediate support plates; and a motor operatively coupling the trigger and the punch pad assembly for reciprocating the punch pad assembly at a rate of between 300 and 700 strokes per minute with a stroke length of between 0.875 and 1.000 inches.

* * * * *